US005605873A

United States Patent [19]

Chang

[11] Patent Number: 5,605,873

[45] Date of Patent: Feb. 25, 1997

[54] PRESSURE-SENSITIVE VERIFICATION SYSTEM AND USE THEREOF

[75] Inventor: John C. H. Chang, Naperville, Ill.

[73] Assignee: Wallace Computer Services, Inc., Hillside, Ill.

[21] Appl. No.: 319,018

[22] Filed: Oct. 6, 1994

Related U.S. Application Data

[62] Division of Ser. No. 75,420, Jun. 14, 1993, Pat. No. 5,395, 138.

[51] Int. Cl.[6] ..... B41M 5/165

[52] U.S. Cl. ..... 503/201; 503/206; 503/209

[58] Field of Search ..... 503/201, 206, 503/209, 226

[56] References Cited

U.S. PATENT DOCUMENTS

| | | | |
|---|---|---|---|
| 2,929,736 | 3/1960 | Miller et al. | 117/36 |
| 3,554,781 | 1/1971 | Matsukawa | 117/36.8 |
| 3,713,861 | 1/1973 | Sharp | 117/15 |
| 3,829,133 | 8/1974 | Smagala-Romanoff | 283/6 |
| 3,954,803 | 5/1976 | Vincent et al. | 260/335 |
| 4,012,419 | 3/1977 | Vincent et al. | 260/335 |
| 4,037,007 | 7/1977 | Wood | 428/199 |
| 4,109,047 | 8/1978 | Fredrickson | 428/307 |
| 4,140,733 | 2/1979 | Meyer, Jr. et al. | 260/897 B |
| 4,175,774 | 11/1979 | Tonges et al. | 283/6 |
| 4,183,989 | 1/1980 | Tooth | 428/195 |
| 4,186,020 | 1/1980 | Wachtel | 106/22 |
| 4,197,346 | 4/1980 | Steven | 428/307 |
| 4,210,346 | 7/1980 | Mowry, Jr. et al. | 283/8 B |
| 4,303,307 | 12/1981 | Tureck et al. | 350/276 R |
| 4,360,548 | 11/1982 | Skees et al. | 428/29 |
| 4,425,386 | 1/1984 | Chang | 427/256 |
| 4,448,445 | 5/1984 | Chang et al. | 346/206 |
| 4,726,608 | 2/1988 | Walton | 283/96 |
| 4,839,396 | 6/1989 | Tusim | 521/88 |
| 4,846,502 | 7/1989 | Chang et al. | 283/57 |
| 4,873,219 | 10/1989 | Brown et al. | 503/204 |
| 4,918,045 | 4/1990 | Matsuoka et al. | 503/213 |
| 5,132,034 | 7/1992 | Hsu et al. | 252/47.5 |
| 5,212,219 | 5/1993 | Griffin | 524/17 |
| 5,250,492 | 10/1993 | Dotson et al. | 503/201 |
| 5,260,252 | 11/1993 | Frangie et al. | 503/206 |
| 5,354,723 | 10/1994 | Gundjian | 503/201 |

FOREIGN PATENT DOCUMENTS

| | | | |
|---|---|---|---|
| 2722427 | 5/1977 | Germany . | |
| 2913321 | 4/1979 | Germany . | |
| 61-248784 | 11/1986 | Japan | 503/26 |
| 1520919 | 12/1975 | United Kingdom . | |
| 9100390 | 1/1991 | WIPO . | |

OTHER PUBLICATIONS

Research Disclosure (No. 18747), Nov. 1979, pp. 638–639.

*Primary Examiner*—B. Hamilton Hess

*Attorney, Agent, or Firm*—Roylance, Abrams, Berdo & Goodman, L.L.P.

[57] ABSTRACT

A pressure-sensitive, laser printer heat-resistant verification system for preventing unauthorized photoduplication of security documents comprising a support bearing an information area comprising a visible principal image, and a verification area comprising a localized, autogenous coating of a pressure-sensitive chromogenic composition for producing a visible colored image by external pressure. The chromogenic composition comprises (a) pressure-rupturable microcapsules containing a chromogen and (b) a color developer capable of reacting with the chromogen to form a visible image. The pressure-rupturable microcapsules and color developer are substantially coextensive on the support, and the verification area is spaced apart from the information area.

25 Claims, 3 Drawing Sheets

FIG. 1
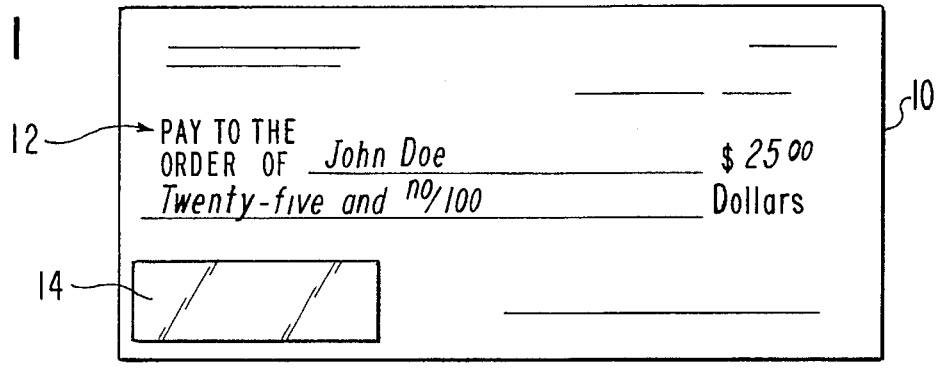
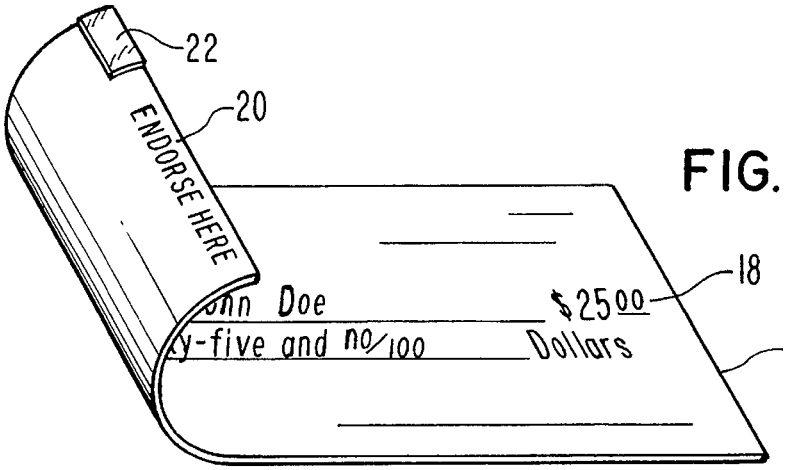
FIG. 2
FIG. 3
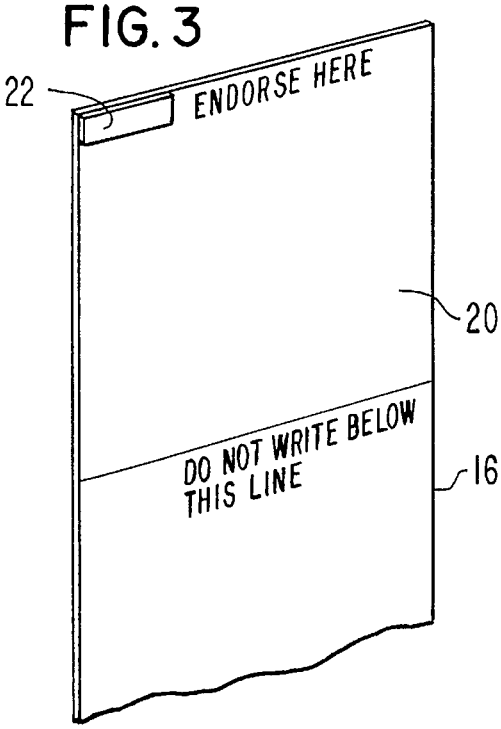
FIG. 4
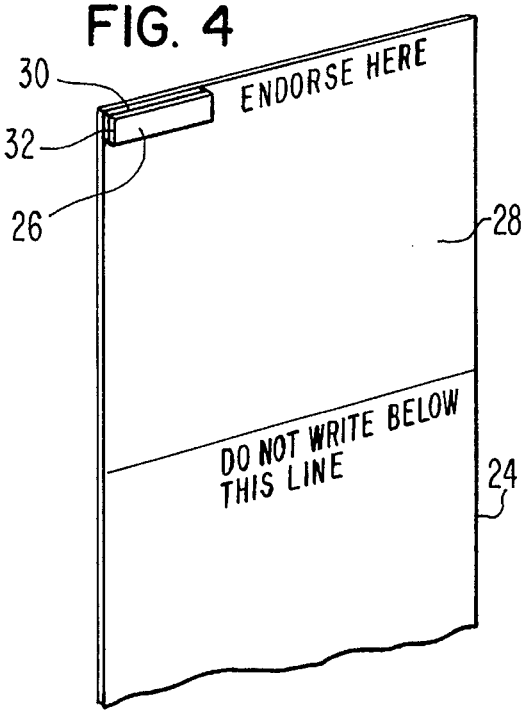

PRESSURE-SENSITIVE VERIFICATION SYSTEM AND USE THEREOF

This is a division of application Ser. No. 08/075,420, filed Jun. 14, 1993, now U.S. Pat. No. 5,395,138.

CROSS-REFERENCE TO RELATED APPLICATIONS

Reference is hereby made to U.S. application Ser. No. 07/987,710 entitled "Heat Sensitive System and Use Thereof" to John C. H. Chang filed Dec. 9, 1992, now U.S. Pat. No. 5,427,415, Ser. No. 07/987,694 entitled "Hidden Entry System and Use Thereof" to John C. H. Chang and Peter A. Walter filed Dec. 9, 1992, now U.S. Pat. No. 5,344,191, and U.S. application Ser. No. 08/075,419 to John C. H. Chang and Richard H. Johnson entitled "Pressure and Heat-Sensitive System and Use Thereof", now U.S. Pat. No. 5,401,060 the disclosures of which are hereby incorporated by reference.

1. Field of the Invention

The present invention is directed to a pressure sensitive verification system for verifying authenticity of a document. More particularly, this invention relates to documents having a localized, pressure-sensitive chromogenic coating that can be activated by application of pressure, but not by heat, to produce a visible colored mark for determining authenticity of the document.

2. Background of the Invention

Various methods of providing documents, such as negotiable instruments, with tamper evident systems to prevent alteration have been proposed. For example, U.S. Pat. No. 4,846,502 to J. Chang and T. Dimitriou discloses a tamper evident system in which a latent image message, such as the word "VOID", appears if someone tampers with the dollar amount on a negotiable instrument, such as a postal money order.

Likewise, systems have also been developed to prevent reproduction of documents by photocopying to reduce the incidence of fraud. However, in recent years advanced color copiers which are readily accessible to the general public can produce nearly exact duplicates of the original document. It is very difficult for the untrained person to distinguish the original document from an illicit reproduction. To prevent passing off of the reproduction as the original, efforts have been made to make the original document incapable of being copied or to incorporate authenticating systems into the document.

More recently, a system for document verification has been developed, which system is disclosed in U.S. application Ser. No. 07/987,710 to John C. H. Chang entitled "Heat Sensitive System and Use Thereof", and involves use of a heat-sensitive chromogenic system in the production of documents to prevent unauthorized or fraudulent use of a xerographic color copier for reproduction of negotiable instruments, such as checks, money orders and the like. When, for example, a check bearing the heat-sensitive chromogenic coating in a verification area thereof is presented for payment, the bank teller can simply apply heat to the verification area, and if a visible image symbol appears in the verification area, the teller will know that the check is an original. In such heat-sensitive record system, a heat-sensitive color developer is coated on the upper surface of the substrate. By subjecting the coating to a heat source or contacting the coating with a heated object, a visible colored mark is instantly produced. This system requires heat which melts or softens the heat-sensitive color developer without external pressure.

Laser printers in the form of desk models to computer-linked high speed models have been increasingly employed to upgrade office equipment for processing documents. Laser printers rely on toner to provide printed indicia on the documents. In order to adhere toner on the documents, heat is provided within the laser printers to melt and set toner on the surface of the documents. While there are many models of laser printer by numerous manufacturers, the heated surface of the fuser roll is at a temperature of, for example, between about 350° F. to about 400° F. When a document is fed into the laser printer, the temperature of the surface directly contacting the fuser roll could approach 400° F. and the opposite surface could reach about 200° F. Thus, a document bearing a heat-sensitive verification system could become prematurely colored, thereby destroying the verification system for such document.

Accordingly, a need still exists for a simple and efficient system which is able to accurately authenticate a document and distinguish it from a reproduction even after it has received printed indicia from a laser printer.

SUMMARY OF THE INVENTION

A laser printer heat-resistant document verification system has now been discovered which can be used to identify an illicit photoreproduction of a security document, such as a payroll check, a pharmaceutic prescription, redeemable coupon, or the like, which system comprises a support bearing an information area and a verification area, the information area comprising a visible principal image, and the verification area comprises a localized, autogenous coating of a pressure-sensitive chromogenic composition for producing a visible colored image by external pressure. The chromogenic composition comprises (a) chromogen-containing pressure-rupturable microcapsules and (b) a color developer capable of reacting with said chromogen to form a visible image. Preferably, the pressure-rupturable microcapsules and the color developer forming the localized chromogenic composition are substantially coextensive and the verification area is spaced apart from the information area to avoid premature rupture of the microcapsules and formation of the verifying image.

The present invention provides a laser printer heat-resistant verification system which can be used in a simple and effective manner to detect unauthorized photoduplicated security documents. The method of the present invention comprises, in sequence, presenting a tendered security document to a receiving authority concerned with authenticity of the tendered security document, the security document comprising a support bearing an information area and at least one verification area, the information area comprising a visible principal image, and the verification area comprising a localized coating of a pressure-sensitive chromogenic composition which provides a visible colored authentication image by application of external pressure. The receiving authority verifies authenticity of the document by applying external pressure to the pressure-sensitive chromogenic composition in at least one of the verification areas to form a visible colored image in the verification area, the visible colored image signifying that the document is authentic, the receiving authority accepting and retaining the authentic security document. The authenticated security document is then surrendered to the receiving authority in exchange for a valuable consideration.

According to one embodiment of the present invention the visible principal image, such as payroll information, is provided by a laser printer subsequent to application of the localized coating of the chromogenic composition to the support. Surprisingly, the chromogenic composition does not prematurely react from the heat of such printer to form a verifying image.

According to another embodiment of the present invention, external pressure is applied to verify authenticity of the security document by means of the pressure of a human fingernail or a stylus.

While the security documents of the present invention can be photocopied, the verification system of the present invention cannot be duplicated by xerographic techniques, but requires application of a chromogenic color-producing system of the present invention to the document. Additionally, unlike heat-sensitive chromogenic systems, heat from a laser printer will not produce a visible color marking from the chromogenic system of the present invention. Rather, the chromogenic system of the present invention is activated only when external pressure is applied.

According to another embodiment of the present invention, the chromogenic composition is applied in the form of a latent image message, such as the word "ORIGINAL" formed of a mixture of the chromogen-containing pressure-rupturable microcapsules and the color developer material. Alternatively, the latent image can be printed using a coating of the color developer material followed by a printed latent image message formed of a printed coating of chromogen-containing pressure-rupturable microcapsules to form the pressure activated coating. Alternatively, the latent image message can be formed of a coating of chromogen-containing pressure-rupturable microcapsules followed by a printed latent image message formed of a printed coating of the color developer. By applying external pressure, for example, by striking the coating with a fingernail or other stylus, the chromogenic compound is released to react with the color developer to produce a visible, colored image in the form of the message. Of course, if a specific latent image message is not desired, a non-message coextensive coating of the chromogen containing microcapsules and the color developer material may be applied in one or more coatings.

According to another embodiment of the present invention, the verification system is applied to a negotiable instrument where the principal image is a numerical and written monetary amount, such as in the case of a check. In this embodiment, the verification area may be in an area adjacent the endorsement area on the reverse side of the check. Thus, when the check is submitted for payment at a bank, for example, the teller can verify authenticity of the check by simply applying external pressure, for example, by use of a fingernail or stylus, to the verification area conveniently located adjacent the endorsement area of the check before cashing the check.

According to a further embodiment of the present invention, the verification area may be treated to conceal the latent image message. Despite use of a colorless or substantially colorless chromogenic verification system, light reflection can reveal a latent image message in the verification system, such as the word "VALID". According to this embodiment of the invention, the latent image message is coated with a thin coating comprising pigment in a binder which conceals the latent image message without substantially reducing color development nor activation characteristics of the chromogenic composition. Alternatively, concealment of the latent image message of the chromogenic coating or the chromogenic coating itself may be accomplished by dot printing the verification area using conventional printing inks in any color other than that of the latent image. Application of the thin pigmented coating or dot printing is preferably accomplished after application of the chromogenic coating.

As used in the present application, the term "principal image" is defined as a visible image which is applied or present on the document in the information area in printed or written form by any means. If the visible image is applied to the document by means of external pressure, such as by use of a typewriter, ballpoint pen or the like stylus subsequent to application of the chromogenic coating to the verification area, such external pressure will cause premature coloring of the verification area. Thus, in such case the verification area and principal image must be spaced apart from one another. However, if the principal image is applied to the document prior to application of the chromogenic coating or is applied without application of external pressure, the verification area and principal image need not be spaced apart.

In the embodiment of the present invention where the document is a negotiable instrument, such as a check, money order, etc., the principal image can be a monetary amount in numerical or written form, name of the financial institution, name of the payor or the payee. Likewise, the principal image can be all or a portion of the written material of the document which is subject to unauthorized reproduction and fraudulent passing off as the original document. Likewise, in the embodiment of the present invention where the document is a medical prescription, the principal image can be both preprinted matter and hand-written information.

Other objects, advantages and salient features of the present invention will become apparent from the following detailed description, which, taken in conjunction with the annexed drawings, discloses preferred embodiments of the invention.

BRIEF DESCRIPTION OF THE DRAWINGS

Referring now to the drawings which form a part of this original disclosure:

FIG. 1 is a front view of a negotiable instrument in the form of a check showing the verification area on the front face of the instrument;

FIG. 2 is a schematic and perspective view of the negotiable instrument in the form of a check showing the verification area above the endorsement area on the reverse side of the instrument;

FIG. 3 is a partial, schematic and perspective view of the check of FIG. 2 in accordance with a preferred embodiment of the invention;

FIG. 4 is a partial, schematic and perspective view of the check of FIG. 2 modified according to one embodiment of the invention;

DETAILED DESCRIPTION OF THE INVENTION

Figure 5:
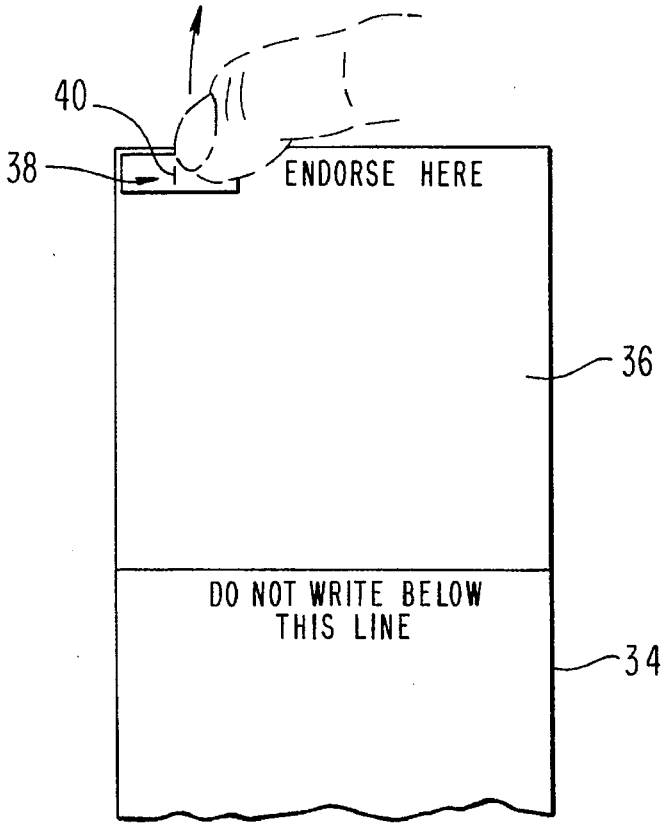
FIG. 5 is a partial view of the check of FIG. 2 having a latent image in the verification area.

Referring to the drawings, FIGS. 1 and 2 illustrate the present verification system in combination with document 10, which in this embodiment is a bank check. Document 10 includes an information area 12 bearing a principal image in the form of the name of the payee and the dollar amount, and a verification area 14 on the front of the check.

The term "document" as used herein is intended to include any type of document or paper which can be reproduced by a photocopier or other reproduction equipment. The documents of particular interest are those documents which have a high incidence of reproduction for fraudulent purposes. In preferred embodiments of the invention, the document is a negotiable instrument such as a money order or check including personal checks, cashier's checks and traveler's checks. In further embodiments, the document may include, for example, pharmaceutical prescriptions, contracts, letters, deeds, wills, bills of exchange, certificates of deposit, warrants, stocks, bonds, identification cards, lottery tickets, sweepstakes, raffles, prizes and awards. As used herein, the expression "negotiable instrument" refers to any instrument which can be exchanged for or represents a monetary amount or its equivalent value.

The information area 12 on the check of the embodiment of FIG. 1 is filled in with specific information, such as the payee's name and dollar amount, which can be provided by a laser printer according to conventional procedures. The information area can include, for example, such information as the date, the amount of the check, the name of the bank, and the payee, all provided by a laser printer. The printed information contained in the information area comprises a principal image of the document.

The verification area 14 in the embodiment of FIG. 1 is positioned in the lower left hand corner of the front face of the check. It is to be understood that the verification area may be located in any position or area on the check and that multiple verification areas may be present, such as on both the front and rear faces of the document. However, it is preferred that the verification area be spaced apart or remote from the information areas, since verification involves formation of a visible colored marking in the verification area, and if such area overlapped an information area, it may interfere with the information contained therein.

A localized coating of the pressure-sensitive, chromogenic composition is applied to the verification area, said coating comprising a) microscopic pressure-rupturable capsules containing a chromogenic material, and (b) a color developing material, such as an electron-acceptor material. Multiple localized pressure activated coatings may be provided on the document at spaced positions to provide multiple verification areas or within a single verification area to provide multiple colors within a single verification area.

The pressure-rupturable microcapsules useful in the chromogenic system of the present invention may be formed in any suitable manner conventionally employed. For example, suitable pressure-rupturable microcapsules are described in U.S. Pat. Nos. B1 4,425,386 and 4,317,743, both to Chang, the disclosures of which are hereby incorporated by reference.

The chromogenic compound to be encapsulated may be any suitable chromogen, such as crystal violet lactone, benzoyl leuco methylene blue, fluorans, phthalides, rhodamine lactams or the like, such as those disclosed in U.S. Pat. No. B1 4,424,386 to Chang and U.S. Pat. Nos. 3,954,803 and 4,012,419 to Vincent and Chang, the disclosures of which are hereby incorporated by reference. In preferred embodiments, the chromogen is colorless or substantially colorless before reacting with the color developer to produce the colored image. Suitable types of chromogenic compounds include diarylmethanes, triarylmethanes, indolylphthalides, azaphthalides, fluorans, and spiropyrans. Exemplary diarylmethanes include 4,4'-bis(dimethylaminobenzhydrylbenzyl)ether, N-halophenyl leuco auramine, and N-2,4,5-trichlorophenyl leuco auramine. Examples of triarylmethanes include 3,3-bis(p-dimethylaminophenyl)-6-dimethylaminophthalide and 3,3-bis(p-dimethylaminophenyl)phthalide. Examples of indolylphthalides include 3-(p-dimethylaminophenyl)-3-(1,2-dimethylindole-3-yl)phthalide and 3-(p-dimethylaminophenyl)-3-(2-methylindole-3-yl)phthalide. Examples of azaphthalides include 3-(2-ethoxy-4-diethylaminophenyl)-3-(1-octyl-2-methylindole-3-yl)-4-azaphthalide and 3-(2-ethoxy-4-diethylaminophenyl)-3-(1-ethyl-2-methylindole-3-yl)-4-azaphthalide. Examples of fluorans include 2-dibenzylamino-6-diethylaminofluoran, 2-anilino-6-diethylaminofluoran, 3-methyl-2-anilino-6-diethylaminofluoran, 2-anilino-3-methyl-6-(ethyl-isopentylamino)fluoran, 2-anilino-3-methyl-6-dibutylaminofluoran, 2-chloro-3-methyl-6-diethylaminofluoran, 3,6-dimethoxyfluoran, and 7,7'-bis(3-diethylaminofluoran). Examples of spiropyrans include 3-methylspirodinaphthopyran, 3-ethylspirodinaphthopyran, 3,3'-dichlorospirodinaphthopyran, 3-benzylspirodinaphthopyran, and 3-methylnaphtho-(3-methoxybenzo)spiropyran.

The chromogen is normally dissolved in a solvent, such as benzyl xylenes, diaryl alkanes, monobutylbiphenyls, monoisopropylbiphenyls, dibutylbiphenyls, di-isopropylbiphenyls, monoisopropylnaphthalenes, di-isopropylnaphthalenes, and hydrogenated terphenyls when encapsulated.

Suitable color developers are electron acceptor materials, such as Lewis acids. Preferred electron-acceptor materials for inclusion in the autogenous layer are the Lewis acids conventionally used to prepare carbonless copy papers. Preferred Lewis acids include, for example, alkylphenol-formaldehyde novolac resins, zinc salts of alkylsalicylic acids, and acid activated clays, and the like.

The microcapsules may be of any suitable size, for example, and have an average diameter of between about 1 to about 20 microns, preferably, between about 3 to about 7 microns to avoid premature rupture. Likewise, a load bearing agent such as starch is added to the autogenous coating to help prevent premature rupture of the microcapsules. The amount of chromogen used is generally the amount needed to react with the Lewis acid in the autogenous layer, and may be present in amount of, for example, from about 1 part by weight to about 30 parts by weight chromogen, preferably, from about 5 parts by weight to about 20 parts by weight chromogen per 100 parts by weight Lewis acid in the autogenous layer.

A suitable binder material is needed to adhere the chromogen-containing pressure-rupturable microcapsules and the color developer onto the substrate. The amount of binder generally used is about 10% to about 50% by weight, and preferably about 15% to about 35% by weight, based on the total weight of the solids of the coating composition. Examples of useful binders include starch, hydroxyethyl cellulose, methyl cellulose, carboxymethyl cellulose, gelatin, casein, gum arabic, polyvinyl alcohol, styrene-maleic anhydride copolymers, ethylene-acrylic acid copolymers, styrene-butadiene copolymers, acrylonitrile-butadiene copolymers, vinyl acetate emulsions, ethylene-vinyl acetate emulsions.

The pressure activated chromogenic composition of the present invention may optionally additionally contain a color suppressant to prevent premature coloration. The color suppressant must be so chosen that it will not inhibit or adversely affect the color formation in the final product. Examples are ammonium hydroxide, alkanolamines, such as monoethanol amine, diethanolamine, N,N-dimethylethanolamine, and the like, condensates of amine-formaldehyde, such as urea-formaldehyde, melamine-formaldehyde, and the like. Suitable amounts of such color suppressants include from about 0.1 to about 10, preferably from about 0.5 to about 4 percent by weight based on the total dry weight of the coating composition. Other suitable color suppressants are disclosed, for example, in U.S. Pat. Nos. 4,010,292 and 4,170,483, which are hereby incorporated by reference.

The chromogenic coating composition is applied to the substrate, for example, paper, plastic, or the like, which forms the document by any suitable technique as known in the art to provide a localized, spot or band coating. In a preferred embodiment of the invention, the chromogenic coating composition is prepared as a homogeneous slurry comprising the chromogen-containing pressure-rupturable microcapsules and the color developer. Any suitable method may be employed for providing the localized coating. A preferred method of coating is by off-set gravure coating as disclosed in U.S. Pat. No. B1 4,425,386 to Chang which is hereby incorporated by reference. Alternative preferred coating methods include flexographic, screen printing, nozzle extrusion and ink jet printing.

Preferably, the chromogenic coating material is activated by quickly rubbing a blunt implement across the verification area to generate sufficient pressure to produce a colored image. For convenience, a suitable implement may be a human fingernail rubbed across the verification area to generate pressure to rupture the microcapsules and release the chromogen to permit contact and reaction between the chromogen and color developer to produce a colored line. Other implements which may be used include a non-writing end of a pen, a stylus, paper clip, coin and the like.

According to a preferred embodiment of the present invention, an ultraviolet light absorbing compound is incorporated into the pressure-rupturable microcapsules along with the chromogenic compound when the pressure-rupturable microcapsules are coated on the verification area. Surprisingly, it was found that if prior to verification, a document of the present invention, such as a check or prescription form, is left uncovered, for example, left near a window in an automobile or near a window in a house, and the verification area becomes exposed to natural light, such as from sunlight or other source of ultraviolet light, the chromogenic material becomes inactive and the verification function of the document is destroyed in a day or so.

Thus, an individual presenting his or her paycheck to the bank for deposit or cash would be refused, since such check could not be verified. When the teller or bank official attempts to obtain color verification of the check by applying pressure to the verification area, no colored image would result, since the chromogenic compound would remain colorless or substantially colorless. However, it has been found that by incorporating an ultraviolet light absorbing compound in the pressure-rupturable microcapsules along with the chromogenic compound, even after exposure to sunlight, the chromogenic compound can react with the color developer upon rupture of the microcapsules containing the chromogenic compound.

Although an ultraviolet light absorbing compound has been incorporated in microcapsules used in the pressure-sensitive recording paper system disclosed in U.S. Pat. No. 3,554,781, such compound is used for a purpose different from that of the present invention. In particular, such recording paper system is concerned with preserving the visible image after it is formed by reaction of the chromogenic compound and color developer on the record sheet, since such sheets are not normally exposed to outside light, if at all, until after a colored image has been formed. Prior to use, such recording paper is stored in boxes or cabinets and is not exposed to sunlight. In contrast, the verification area on the personal checks, prescriptions or other documents of the present invention may well be exposed to daylight, since such document must be taken by the payee or patient, respectively, to a bank or drugstore to be negotiated. Thus, use of the ultraviolet light absorbing compound as used on the documents of the present invention preserves the integrity of the verification area of the documents by protecting the chromogenic compound in the capsule prior to reaction, rather than after it has reacted with the color developer to form a colored marking on a record sheet.

Any suitable ultraviolet light absorbing compound may be encapsulated along with the chromogenic compound of the present invention. Preferred ultraviolet light absorbing compounds for use in the present invention include, for example, the substituted benzotriazoles available from Ciba-Geigy under the tradename "Tinuvin", such as Tinuvin P disclosed in U.S. Pat. Nos. 3,004,896 and 3,189,615, which are hereby incorporated by reference, having the general formula 2-(5'-methyl-2'-hydroxyphenyl)benzotriazole; Tinuvin 326, which has the general formula 2-(5'-methyl-3'-tert-butyl-2'-hydroxylphenyl)-5-chlorobenzotriazole; Tinuvin 327, having the general formula 2-(3',5'-di-tert-butyl-2'-hydroxyphenyl)-5-chlorobenzotriazole; Tinuvin 328, which has the formula 2-(3',5'-di-tert-pentyl-2'-hydroxyphenyl)benzotriazole, and Tinuvin 900, disclosed in U.S. Pat. No. 4,278,589, which is hereby incorporated by reference, which has the formula 2-[2-hydroxy-3,5-di(1,1-dimethylbenzyl)phenyl]-2-H-benzotriazole.

The ultraviolet light absorbing compound is used in any suitable amount, for example, from about 5 to about 150 weight percent, based upon the weight of the chromogenic compound, with a preferred amount being from about 20 to about 80 weight percent, based on the weight of the chromogenic compound.

According to another embodiment of the present invention, it has been found that hindered phenols normally used as antioxidants to hinder thermally-induced oxidation of polymers in coatings for high temperature applications, for example, to prevent yellowing caused by heat, act as stabilizers for the chromogen in the capsules. The hindered phenols can be used in place of the benzotriazole ultraviolet light absorbing compounds. Surprisingly, it has been found that hindered phenols stabilize chromogen in the microcapsules when exposed to sunlight even at ambient temperatures.

Suitable hindered phenols include, but are not limited to, for example, 2,6-di-tert-butyl-p-cresol; 4,4'-methylene bis(2,6-di-tert-butylphenol); 4-methyl-2,6-bis(2'-hydroxy-3'-tert-butyl-5'-methylbenzyl)phenol; the Irganox hindered phenols, such as Irganox 129, Irganox 245, Irganox 1010, Irganox 1076, Irganox 1035 and Irganox MD 1024 commercially available from Ciba-Geigy Corporation. Such hindered phenols have the general structural formula

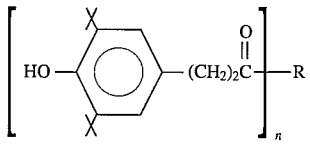

wherein R is an alkoxy, a substituted alkoxy, or —NH—NH— group and n is an integer from 1 to 4. For example, R is $C(CH_2O—)_4$ when n=4, R is $—O—C_{18}H_{37}$ when n=1, R is $—O—(CH_2)_2—S—(CH_2)_2—O—$ when n=2, and R is —NH—NH— when n=2.

Irganox 129 is 2,2'-ethylidene-bis(4,6-di-tertbutylphenol); Irganox 245 is ethylene bis(oxyethylene)-bis(3-tert-butyl-4-hydroxy-5-methylhydrocinnamate); Irganox 1010, which is identified as tetrakis[methylene-3-(3',5'-di-tert-butyl-4'-hydroxyphenyl)propionate]methane; Irganox 1076 is octadecyl 3,5-di-tert-butyl-4-hydroxyhydrocinnamate; Irganox 1035 has the general formula

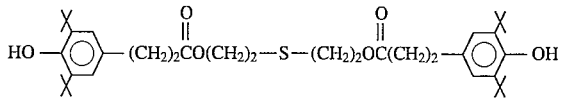

while Irganox MD 1024 has the general formula

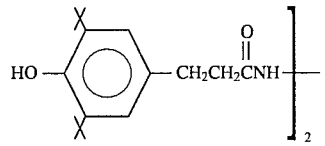

Any hindered phenol useful as an antioxidant is useful as a stabilizer for the chromogen in the capsules of the present invention. The hindered phenol stabilizer is used in any suitable amount, for example, from about 5 to about 150 weight percent, based upon the weight of the chromogenic compound, with a preferred amount being from about 20 to about 80 weight percent based on the weight of the chromogenic compound. Surprisingly, it was found that the hindered phenol can be used in place of a benzotriazole and still provide effective stability for the chromogen in the capsules.

In a further embodiment illustrated in FIGS. 2 and 3, a document in the form of check 16 comprises an information area 18 having a principal image. The principal image in the information area 18 contains a conventional printed image as in the embodiment of FIG. 1. Also included on the check of this embodiment is a designated endorsement area 20 on the back face of the check opposite the principal image. The endorsement area 20 defines the area at one end of the check for the payee's endorsement. As shown in FIGS. 2 and 3, the endorsement area includes a pre-printed principal image providing instructions for the person endorsing the check according to standard banking procedures. In the upper left corner of the check above the endorsement area as shown in FIGS. 2 and 3 is a verification area 22 comprises a coating of a homogenous mixture of the chromogen-containing pressure-rupturable microcapsules and the color developer to form an autogenous chromogenic coating. In this manner, the verification area is in a handy position above the endorsement area of the check. Thus, if the check is submitted for payment, the person receiving the check can verify authenticity of the check by quickly rubbing a fingernail or other hard object across the verification area above the signature to produce a colored image.

Verification area 22 can be, for example, a solid, regular shaped coating in the form of a rectangle, as shown, which provides a single visible colored line when a fingernail is used to rub or strike a line across the surface of the coating to generate external pressure in the coating. Alternatively, rectangular verification area 22 may be formed of multiple chromogenic coatings, for example, three side-by-side rectangular-shaped chromogenic coatings, each rectangular coating providing a different color when pressure is applied. Thus, when the fingernail or other stylus is quickly drawn across and in contact with area 22, a line composed of, for example, blue, green and red segments results.

The verification system of the invention provides an effective and simple way of preventing fraudulent passing off of a reproduction of an original document. The chromogenic coating of the present invention is colorless until activated and, thus, it would not be apparent to the would-be forger that the original contains the chromogenic coating forming the verification system. Although advanced copiers are able to make copies which are virtually indistinguishable to the naked eye, the photocopier cannot reproduce the chromogenic coating. Thus, when the lawbreaker presents the photocopied document, authenticity of the document can be quickly verified by application of external pressure in the verification area to produce a colored image. In this manner, a document such as a check, money order or prescription, which is suspected of being a fraudulent copy, can be authenticated by a store clerk or bank teller without the need for specialized equipment or training. When a colored image appears in the area, the authenticity of the document is verified. Failure to produce a colored image indicates that the document is a copy and not the original.

The chromogenic coating is colorless and remains nonreactive at room temperature without application of external pressure. The chromogenic coating can therefore be located in any position on the document both without being noticeable and without premature activation with normal handling of the document. Preferably, the chromogenic coating of the present invention can is in an area of the document which is spaced apart or remote from principal images, such as monetary amounts, so as not to alter appearance of such principal images, such as monetary amounts.

The chromogenic coating in the verification area in preferred embodiments is formed from at least one chromogenic compound and a color developer. In the embodiments of FIGS. 1–3, the chromogen-containing microcapsules and the color developer are intimately mixed and applied to the information area as a uniform coating. In this manner, external pressure applied by an object to any portion of the coating in the information area will produce a colored image in that portion only.

To have an eye catching result to verify authenticity of the document, for example, it may be desirable for the autogenous chromogenic coating to present a striking color contrast to that of the principal image. For example, the dollar amount of a check or the printed information on the check may be in black ink and the color developed by the autogenous coating can be red, violet, orange, green, blue, or yellow to obtain a high degree of contrast. Alternatively, the developed color can be coordinated with the requirements of the financial institution in the case of a check or money order, and may be, for example, the same color as the principal image. Of course, highly contrasting colors can be used, and multiple chromogenic coatings each producing a different colored visible image can be used in the verification area.

In a further embodiment illustrated in FIG. 4, the chromogenic composition is coated onto the document 24 within the verification area 26. The verification area 26 is shown above the endorsement area 28 on the rear face of the check in a manner similar to the embodiment of FIG. 2. The endorsement area 28 includes indicia such as instructions to endorse within the endorsement area. In this embodiment, the chromogenic coating composition in the verification area is applied as a multi-layer coating within the localized area. Thus, the color developer is applied to the substrate of the document as a first layer 30. A second layer 32 comprising chromogen-containing pressure-rupturable microcapsules is coated over the first layer to provide the colored image forming coating system.

The chromogenic coating in the verification area can be pressure activated in a manner similar to the embodiment of FIG. 2, for example, by rubbing or striking the coating with a blunt object to provide external pressure and produce the colored image, thereby verifying the document as an original.

Alternatively, the chromogen-containing pressure-rupturable microcapsules can be applied first onto the substrate, according to the process described in the above-mentioned U.S. Pat. No. B1 4,425,386. The color developer are then coated onto or printed over the first coating. The color reactants may be dissolved or dispersed in a vehicle such as a printing ink base, and the resulting solution printed onto the substrate.

As shown in FIG. 5, the verification area 38 above endorsement area 36 in document 34 can be merely scratched with the human fingernail to provide external pressure to rupture the microcapsules and release the chromogen for contact with the color developer to produce a colored mark 40. Thus, by this simple action, a bank teller can verify authenticity of the check when presented for payment.

Figure 6:
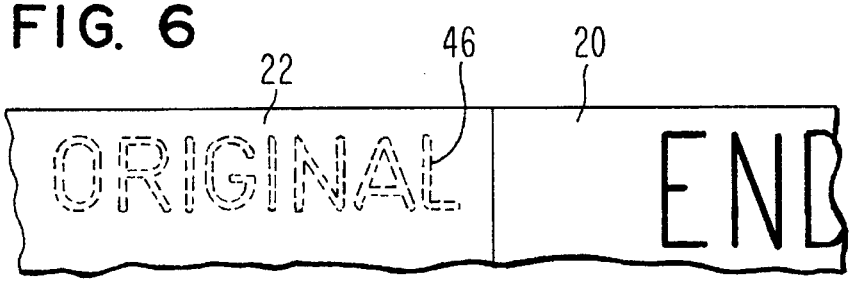
FIG. 6 is a partial view of a check similar to FIG. 3, modified according to a different embodiment having a latent image message in the verification zone after applying external pressure to the verification area.
Figure 7:
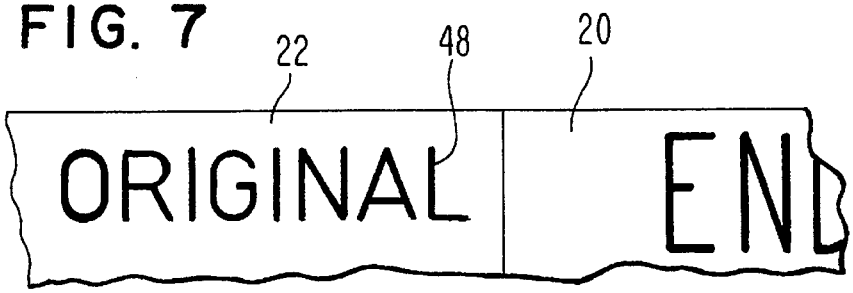
FIG. 7 is a partial view of the check of FIG. 6 having the colored image completely displayed after applying external pressure to provide verification of the authenticity of the check.

In a further embodiment illustrated in FIGS. 6 and 7, a partial view of a modified version of the check 16 of FIG. 3 is illustrated including an endorsement area 20 having a verification area 22 comprising the autogenous chromogenic composition of the present invention as a latent image autogenic coating 46 printed in the message "ORIGINAL". The chromogen-containing pressure-rupturable microcapsules and color former are formed into a colorless ink and printed to form the word "ORIGINAL" or other alerting message 46 as a latent image which had been previously coated on verification area 22.

As shown in FIG. 7, the latent image message is converted to visible image 48 by applying external pressure to latent image 46.

In use, authenticity of the check can be distinguished from a photocopy or other form of reproduction without the need for specialized equipment. The verification system is activated by applying external pressure, such as by quickly rubbing the verification area with a human fingernail or other blunt object. Applying repetitive strokes across the verification area will cause the entire image 48 to develop as shown in FIG. 7. The verification area may be located in a predetermined location on the security document, which may be varied over time for security reasons. Likewise, the color developed in the latent image may be changed as desired as a further means of avoiding unauthorized duplication.

In the embodiment of FIGS. 6 and 7, the latent image 46 is in the form of a word. In alternative embodiments, the latent image can be, for example, a business logo, design, diagram, serial number, combinations of numbers and letters, or other indicia capable of identifying the document. Verification area 22 in FIG. 3, for example, may also be extended across the top of the check and include pre-printed indicia to provide instructions for use and operation of the verification system. For example, such instructions can read "Scratch here to have color appear—if no color appears, do not accept this document."

Figure 8:
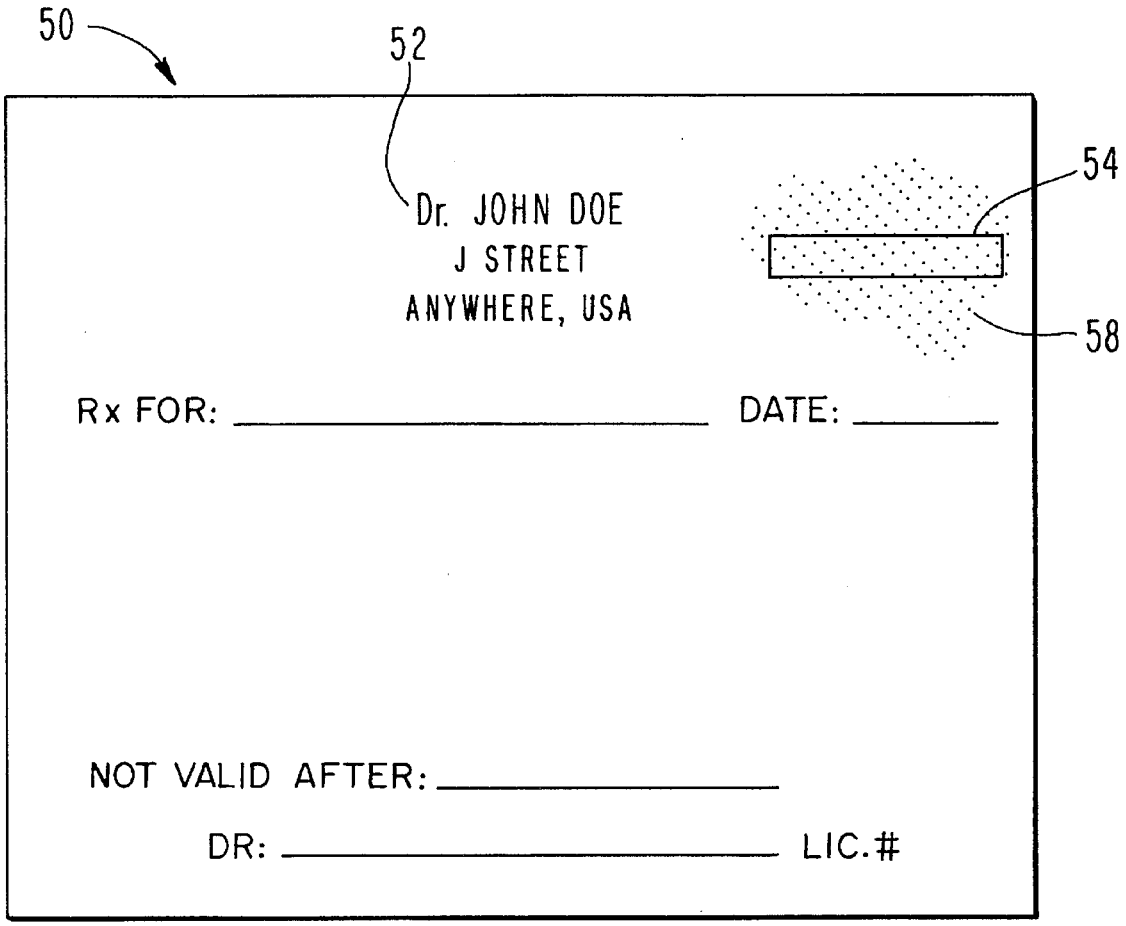
FIG. 8 is a front view of a prescription blank showing the verification area in the upper portion of the blank in accordance with a preferred embodiment of the invention.

In the embodiment of FIG. 8, prescription form 50 is provided with printed matter 52 including the prescribing doctor's name and office address number. Verification area 54 comprises a black color-producing autogenous chromogenic composition in the form of a solid rectangle. The verification area 54 comprising the localized coating of a chromogenic composition may be treated so as to conceal location of the latent image message, since light reflection can reveal location of the verification system. Thus, the latent image message is coated with a thin coating comprising pigment in binder which conceals the latent image message without substantially reducing activation characteristics of the chromogenic coating. A suitable coating may comprise, for example, inorganic fillers, such as calcium carbonate, titanium dioxide, talc, clay, or the like, in a polyvinyl alcohol solution. The thin coating provides the same texture to the support as the coating forming the latent image message and, thus, effectively conceals the message. Alternatively, concealment of the latent image message of the chromogenic coating may be accomplished by dot printing the latent image message or the entire surface of the document including the verification area using conventional printing inks in any color other than that of the latent image. Since the chromogenic composition is colorless, but contains a pressure-rupturable element, the pigmented coating or dot printing is preferably applied after application of the chromogenic composition coating to the substrate. Accordingly, form 50 is coated with dot printing 58 of a printing ink solution which may be a white pigment coating applied to the entire surface of form 50 prior to printing of information, such as 52, to conceal the location of entire verification area 54.

After prescription 50 is completed by the physician and presented at the drug store to be filled, the pharmacist or clerk may easily verify that it is an original rather than a reproduction, by applying external pressure with a fingernail or stylus to the verification area located in a predetermined area on the face of the prescription. Thus, if the clerk rubs or strikes a fingernail quickly across the center of the entire verification area 54, a colored line, which may be black, red, black in sequence, will result from the pressure, signifying that it is an original. The prescription is retained by the pharmacy and the customer is presented with the filled prescription.

The invention will be further illustrated by the following example. It should be understood that it is not intended to limit the scope of this invention. All percentages are by weight unless otherwise indicated.

EXAMPLE 1

A chromogenic composition is prepared by mixing 100 grams of alkylphenol-formaldehyde novolac resin dispersion as color developer at 48.6 weight percent solids, 140 grams of melamine-formaldehyde condensate at 65 weight percent solids, 140 grams of starch powder from Ogilvie Mills Ltd. and 250 grams (32.2 weight percent solids) of capsule slurry containing 5 grams of 3-diethylamino-7-dibenzylaminofluoran encapsulated as color former. The resulting mixture is spot-coated as a rectangle on the back side of a check above the endorsement area to provide an autogenous or self-contained chromogenic coating. Upon drying, the check is passed through a laser printer to provide payee and payment information. Inspection of the autogenous spot coating reveals no effect, such as premature coloration, from the heat of the laser printer. Striking the coating with a fingernail immediately produces a green-colored line.

EXAMPLE 2

To 200 grams, at 35 weight percent solids, of capsule slurry containing an encapsulated mixture of 6.4 grams of a leuco dye, Pergascript Red I-6B color former from Ciba-Geigy Corporation, and 4.3 grams of Tinuvin 327 ultraviolet light absorber from Ciba-Geigy Corporation are added 120 grams of melamine-formaldehyde condensate at 65 weight percent solids, 100 grams of alkylphenol-formaldehyde novolac resin dispersion at 40.6 weight percent solids, and 120 grams of starch powder from Ogilvie Mills Ltd. The mixture is mildly agitated for about 30 minutes.

The resulting mixture is then spot-coated on the face of a prescription blank, dried and printed with a laser printer to provide a doctor's name and office address on the face spaced apart from the autogenous spot coating. Inspection of the autogenous spot coating reveals no effect, such as premature coloration, from the heat of the laser printer. Striking the coating with a fingernail immediately produces a red-colored line.

While the document verification system of the present invention has particular application to documents that are subjected to the temperatures of a laser printer, it is apparent that the present document verification system may also be used for verification of the authenticity of documents which are not to be processed by a laser printer.

Although the invention has been described with a certain degree of particularity, it is understood that the present disclosure has been made only by way of example and that numerous changes in the details of construction and the combination and arrangement of parts may be resorted to without departing from the spirit and scope of the invention. Thus, the scope of the invention should not be limited by the foregoing specification.

What is claimed is:

1. A verification method for avoiding acceptance of an unauthorized photoduplicated security document, which comprises, in sequence, presenting a tendered security document to a receiving authority, said receiving authority being concerned with authenticity of said tendered security document, said security document comprising a support bearing an information area and at least one verification area, said information area comprising a visible principal image;

said verification area comprising a localized coating of a pressure-sensitive chromogenic composition which provides a visible colored authentication image by external pressure;

said receiving authority verifying authenticity of said document by applying external pressure to said pressure-sensitive chromogenic composition in at least one of said verification areas to form a visible colored image in said verification area, said visible colored image signifying that said document is authentic and not a photoduplicate;

said receiving authority accepting and retaining said authentic security document;

said authenticated security document being surrendered to said receiving authority in exchange for a valuable consideration.

2. The method of claim 1 wherein said visible principal image and said verification area are spaced apart.

3. The method of claim 1 wherein said visible principal image is provided by a laser printer subsequent to application of said localized coating to said security document.

4. The method of claim 3 wherein said security document is a payroll check and said valuable consideration is cash.

5. The method of claim 4 wherein all portions of said visible principal image and said verification area are spaced apart.

6. The method of claim 5 wherein the information area is on the front of the check and the verification area is on the back of said check.

7. The method of claim 3 wherein said security document is a prescription and said valuable consideration is prescription drugs.

8. The method of claim 7 wherein all portions of said visible principal image and all portions of said verification area are spaced apart.

9. The method of claim 1 wherein said pressure-sensitive chromogenic composition comprises (a) solvent and chromogen-containing pressure-rupturable microcapsules, and (b) a color developer capable of reacting with said chromogen to form a visible image.

10. The method of claim 9 wherein said pressure-rupturable microcapsules additionally contain an ultraviolet light absorbing compound.

11. The method of claim 10 wherein said ultraviolet light absorbing compound is a benzotriazole.

12. The method of claim 11 wherein said ultraviolet light absorbing compound is present in an amount of from about 5 to about 150 weight percent based upon the weight of said chromogen.

13. The method of claim 12 wherein said ultraviolet light absorbing compound is present in an amount of from about 20 to about 80 weight percent based upon the weight of said chromogen.

14. The method of claim 10 wherein said security document is exposed to natural light prior to being received by said receiving authority.

15. The security document of claim 9 wherein said pressure-rupturable microcapsules additionally contain a hindered phenol to stabilize said chromogen.

16. The security document of claim 9 wherein said hindered phenol is Irganox 129, Irganox 245, Irganox 1010, Irganox 1035, Irganox MD 1024 or Irganox 1076.

17. The security document of claim 16 wherein said hindered phenol is present in an amount of from about 5 to about 150 weight percent based upon the weight of said chromogen.

18. The security document of claim 17 wherein said hindered phenol is present in an amount of from about 20 to about 180 weight percent based upon the weight of said chromogen.

19. The method of claim 9 wherein all portions of said visible principal image and all portions of said verification area are spaced apart.

20. The method of claim 1 wherein said microcapsules and said color developer are coextensive.

21. The method of claim 20 wherein said chromogenic composition is a homogeneous mixture of microcapsules and color developer.

22. The method of claim 20 wherein said localized coating of said chromogenic composition is formed by separately coating said microcapsules and said color developer.

23. The method of claim 1 wherein said external pressure is applied by a human fingernail.

24. The method of claim 1 wherein said external pressure is applied by a stylus.

25. The method of claim 1 wherein all portions of said pressure-sensitive chromogenic composition are spaced apart from said visible principal image.

* * * * *